United States Patent [19]

Montealegre et al.

[11] 4,438,848

[45] Mar. 27, 1984

[54] CUSHIONING CARTON

[75] Inventors: James Montealegre, St. Paul; James L. Rader, Burnsville, both of Minn.

[73] Assignee: Container Corporation of America, Chicago, Ill.

[21] Appl. No.: 410,042

[22] Filed: Aug. 20, 1982

[51] Int. Cl.[3] ..... B65D 81/02; B65D 85/30

[52] U.S. Cl. ..... 206/588; 206/45.14; 206/476; 206/485; 229/34 HW

[58] Field of Search ..... 206/45.14, 45.19, 277, 206/461, 462, 476, 485, 521, 557, 559, 561, 562, 563, 564, 565, 588, 589, 590, 592; 229/15, 27, 31 FS, 34 B, 34 HW, 34 R

[56] References Cited

U.S. PATENT DOCUMENTS

| | | | |
|---|---|---|---|
| 2,638,210 | 5/1953 | Sparks | 206/45.14 |
| 2,670,125 | 2/1954 | Frankenstein | 229/34 HW |
| 2,744,622 | 5/1956 | Sparks | 206/590 |
| 2,827,219 | 3/1958 | Sparks | 206/592 |
| 3,182,885 | 5/1965 | Maio | 206/592 |
| 3,326,444 | 6/1967 | Farquhar | 229/27 |
| 3,554,402 | 1/1971 | Lock | 229/27 |
| 4,026,411 | 5/1977 | Johnson | 206/45.19 |
| 4,121,752 | 10/1978 | Ravotto et al. | 229/27 |
| 4,146,127 | 3/1979 | Bayer | 206/45.14 |

FOREIGN PATENT DOCUMENTS

| | | | |
|---|---|---|---|
| 821381 | 8/1969 | Canada | 229/27 |
| 2224939 | 12/1973 | Fed. Rep. of Germany | 229/34 R |

*Primary Examiner*—George E. Lowrance
*Assistant Examiner*—Jimmy G. Foster
*Attorney, Agent, or Firm*—Richard W. Carpenter; Davis Chin

[57] ABSTRACT

A folding carton having an integral, internal support structure including a pair of tubular members for receiving portions of a packaged article and cushioning it by preventing it from coming in contact with the exterior walls of the carton.

5 Claims, 5 Drawing Figures

CUSHIONING CARTON

BACKGROUND OF THE INVENTION

1. Field of the Invention

This invention relates generally to folding cartons, and more particularly to a folding carton having an integral, internal supporting structure which includes a pair of tubular members adapted to hold and cushion a packaged article by preventing the article from coming in contact with the exterior walls of the carton.

2. Description of the Prior Art

A prior art search directed to the subject matter of this application in the U.S. Patent and Trademark Office disclosed the following Letters Patent: U.S. Nos. 1,865,268; 2,110,600; 2,393,734; 2,397,041; 2,621,783; 2,860,823; 2,939,622; 2,946,433; 3,118,591; 3,182,886; 3,252,566; 3,383,028; 3.386.004; 3,910,484; 4,026,411; 4,131,198; 4,159,765; 4,213,598. French Patent No. 1,192,574.

None of the prior art patents uncovered in the search discloses a carton having an internal cushioning structure comprising a pair of separate tubular members suspended on opposed end walls of the carton above the bottom wall of the carton and which are adapted to receive portions of a packaged article and cushion the article by preventing it from coming in contact with any of the exterior walls of the carton.

SUMMARY OF THE INVENTION

It is an object of the invention to provide a folding carton for holding a fragile article and cushioning the article to prevent it from being damaged by coming in contact with one of the exterior walls of the carton.

A more specific object of the invention is the provision of a folding carton having an internal support structure which cradles the packaged article in a positon above the bottom wall of the carton.

A more specific object of the invention is the provision of an internal structure for a cushioning carton which includes a pair of separate tubular members cooperating with each other to receive opposite portions of the packaged article and suspend the article within the carton above the bottom wall thereof.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF PREFERRED EMBODIMENT

Figure 1:
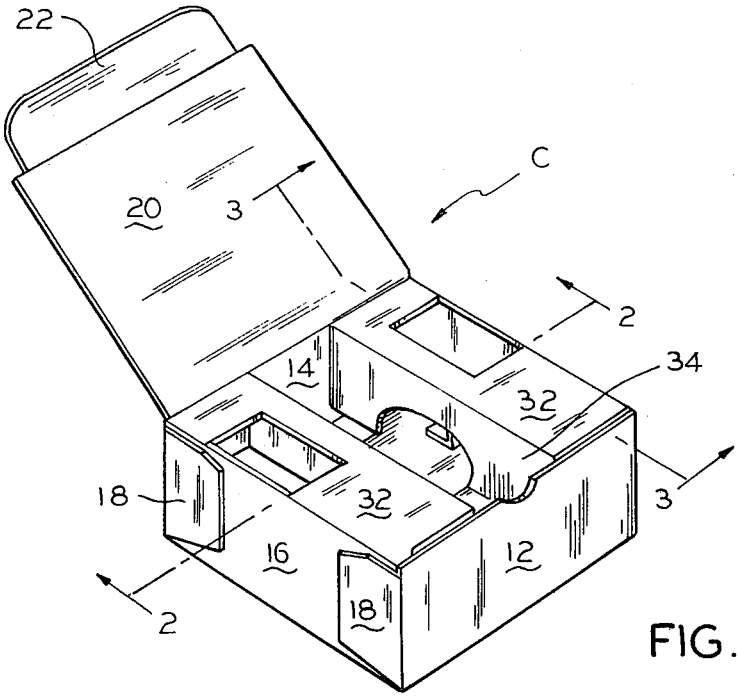
FIG. 1 is a perspective view of a carton embodying features of the invention, as shown in the erected and open positon.
Figure 3:
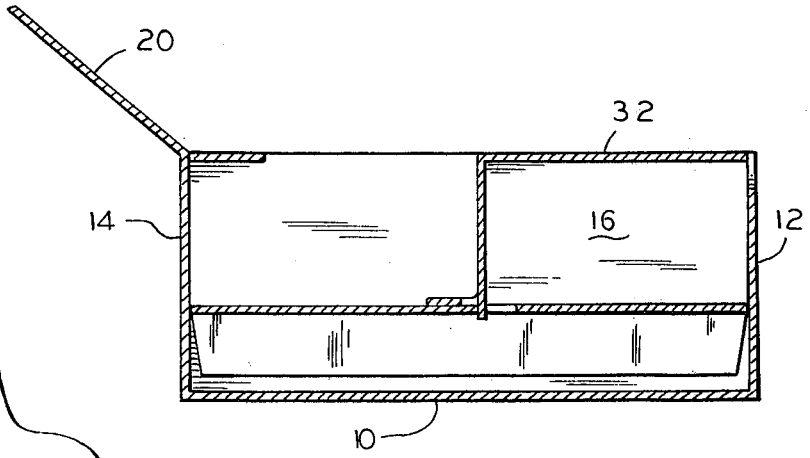
FIGS. 2 and 3 are vertical sectional views taken on line 2—2 and line 3—3, respectively, of the structure illustrated in FIG. 1.
Figure 2:
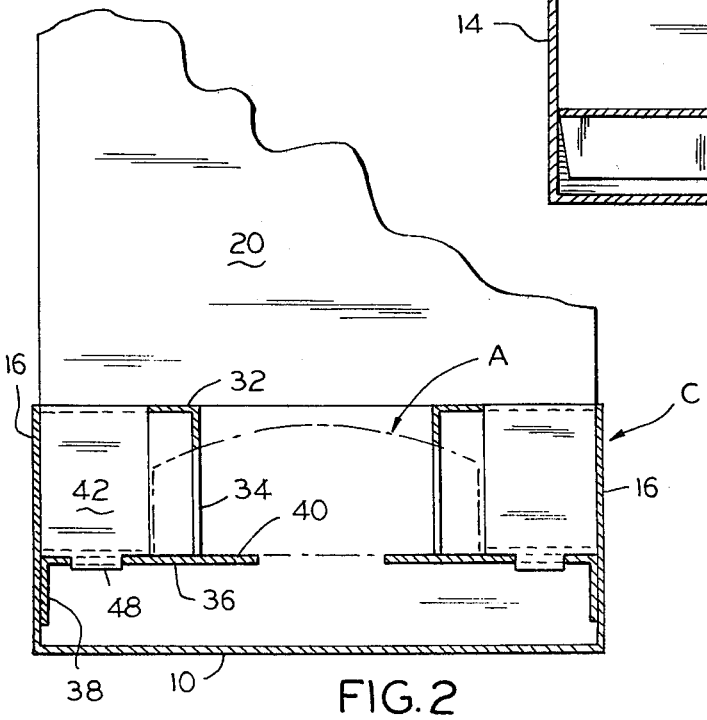

Referring now to the drawings for a better understanding of the invention, and particularly to FIGS. 1 and 2, it will be seen that the novel carton, indicated generally at C, includes an integral, internal support structure adapted to hold and cushion a fragile article, such as a thermostat control device indicated generally at A in FIG. 2.

Figure 5:
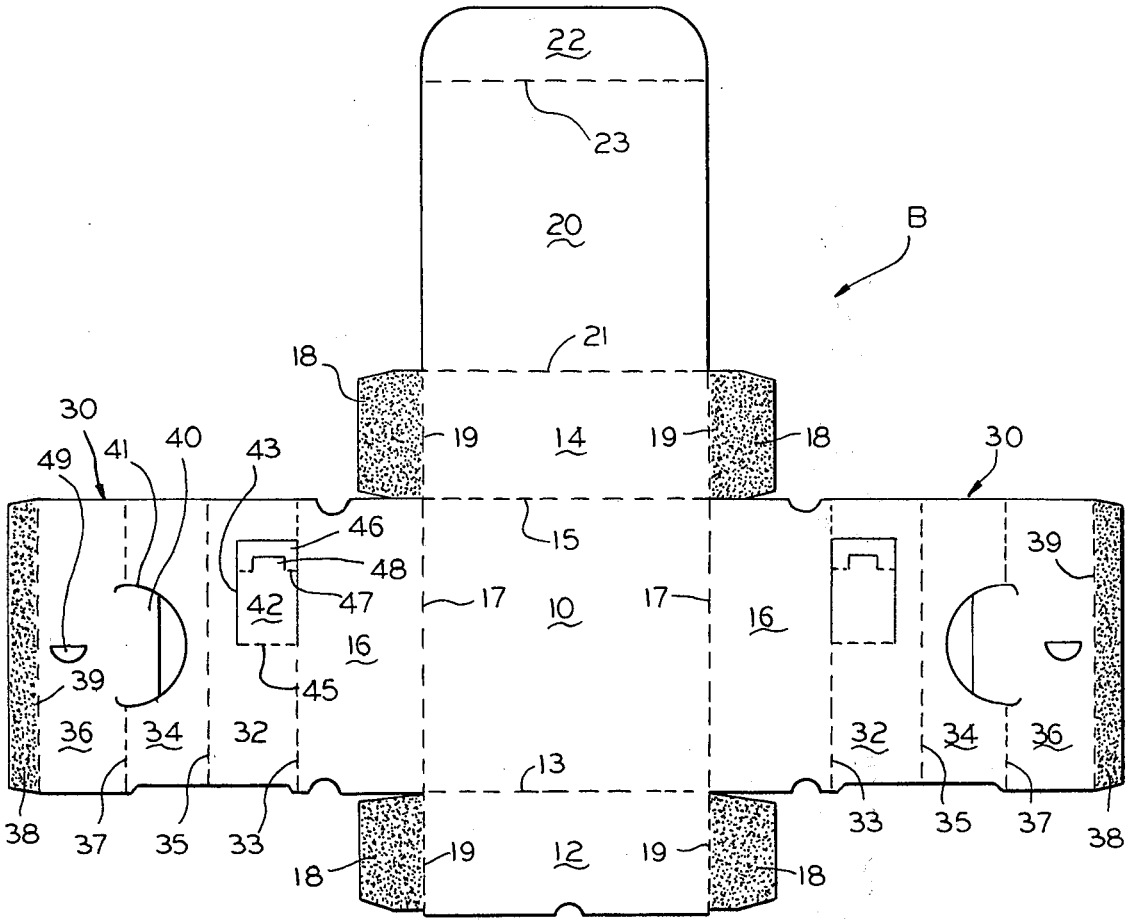
FIG. 5 is a plan view of a blank of foldable sheet material from which the carton illustrated in the other views may be formed.

The carton C, including the internal cushioning structure, may be formed from a unitary blank B of foldable sheet material, such as paperboard, illustrated in FIG. 5. The body of the carton includes a preferably rectangular bottom wall panel 10 having pairs of opposed front and rear side wall panels 12 and 14 and end wall panels 16 foldably joined to opposed side and end edges thereof along fold lines 13, 15, and 17, respectively.

Figure 4:
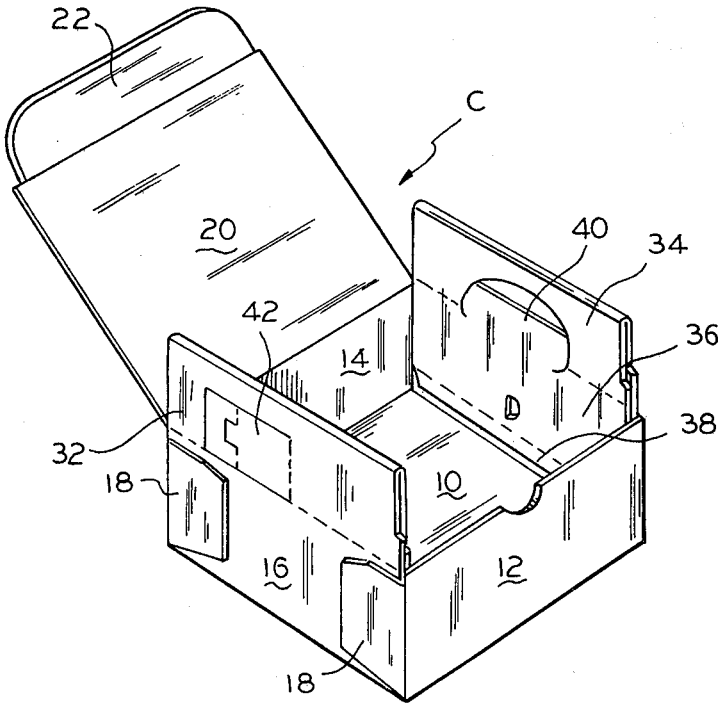
FIG. 4 is a view similar to FIG. 1, but showing the carton in the process of being erected.

A pair of corner connecting flaps 18 are foldably joined on fold lines 19 to opposite ends of front and rear side wall panels 12 and 14 and are adapted to be secured in any desired manner, such as by adhesive, to the outer surfaces of related end wall panels 16 to form a tray or box-like structure as best seen in FIG. 4.

A cover for the body portion of the carton may be provided by a top wall panel 20 foldably joined at its rear edge on fold line 21 to the upper edge of rear side wall panel 14. The cover may also include a tuck flap 22 foldably joined at its upper edge on fold line 23 to the forward edge of top wall panel 20. Tuck flap 22 is adapted to be inserted behind front side wall panel 12 of the carton when the carton is in a closed position.

The integral, internal supporting and cushioning structure for the carton includes a pair of separate tubular members, each indicated generally at 30, which are supported by opposite side walls of the carton in spaced relation to each other and which cooperate in receiving portions of a packaged article and support the article, as best seen FIG. 2.

Each of the tubular members 30 includes an upper panel 32, an inner side panel 34, a lower panel 36, and an anchor panel or glue flap 38 which are foldably joined to the upper edge of related end wall panels 16 and to each other on fold lines 33, 35, 37, and 39, as best seen in FIGS. 2 and 5.

Again referring to FIG. 2, it will be seen that the anchor panel 38 is adhesively secured to the inner surface of the related carton end wall panel 16, so that the entire tubular structure is positioned in spaced relation to the bottom wall panel of the carton and is also spaced from the other tubular structure 30.

Still referring to FIG. 2, it will be seen that lower panel 36 has an integral projection or shelf 40 projecting inwardly toward a similar shelf of the other tubular member. The shelves 40, which cooperate to help in supporting a packaged article, are each formed by material of the related inner wall 34 and are cut therefrom along a cut line 41. When tubular members 30 are erected in position, with generally rectangular cross section, there is provided a vertical strut 42, which is formed from material of upper panel 32 and defined by a cut line 43. Strut 42 is foldably joined to upper panel 32 along a fold line 45 and is adapted to extend downwardly at right angles thereto.

At its lower end each strut 42 is provided with a foot 46 foldably joined along fold line 47 to the lower end edge of the strut and disposed to at right angles to the strut for engagement with the upper surface of lower panel 36. Each strut 42 also includes an extension 48 projecting from the lower end thereof and receivable withing opening 49 of lower panel 36.

Thus, it will be appreciated that the internal cushioning structure comprises a pair of separate tubular members which are so mounted as to be supported entirely by the side wall panels of the carton and which are spaced above the bottom wall of the carton so they can completely cushion the package article by suspending it in the carton free from contact with the exterior walls of the carton.

What is claimed is:

1. A carton, formed of a unitary blank of foldable paperboard, for holding and cushioning a packaged article, comprising:

(a) a bottom wall panel having pairs of opposed front and rear side wall panels and end wall panels foldably joined to side and end edges thereof and to each other and upstanding therefrom to form a box-like structure;

(b) a cover for said structure which includes a top wall panel;

(c) an integral, internal support structure for holding a fragile article in a predetermined position spaced from said front and rear side, end, bottom, and top wall panels; and (d) said support structure comprising a pair of cooperating opposed tubular members spaced from each other at opposite ends of said carton and each including:

(i) an upper panel foldably joined at its outer edge to an upper edge of a related end wall panel and extending inwardly therefrom;

(ii) an inner side panel foldably joined at its upper edge to an inner edge of said upper panel and extending downwardly therefrom;

(iii) a lower panel foldably joined at its inner edge to a lower edge of said inner side panel and extending outwardly therefrom toward said related end wall panel in spaced relation to said bottom wall panel, said lower panel having an integral shelf panel formed by material of the related said inner side panel, said shelf panel projecting inwardly toward and adapted to cooperate with a related shelf panel of the other tubular member to support the packaged article above said bottom wall panel;

(iv) an anchor panel foldably joined to an outer edge of said lower panel and secured to an inside surface of said related end wall panel; and (v) a vertical strut formed from material within said upper panel thereof and extending downwardly therefrom at right angles to said lower panel and engaging said lower panel.

2. A carton as claimed in claim 1, further comprising a pair of corner connecting flaps foldably joined to opposite ends of said opposed front and rear side wall panels and being adapted to be secured to outer surfaces of said end wall panels.

3. A carton as claimed in claim 1, further comprising a tuck flap foldably joined to said top wall panel and being adapted to be inserted behind said front side wall panel.

4. A carton as claimed in claim 1, further comprising an opening formed in said lower panel and an extension projecting from said vertical strut, said extension being receivable within said opening to maintain said tubular member in the erected condition.

5. A carton as claimed in claim 4, wherein said vertical strut is provided with a foot disposed at right angles thereto for engagement with the upper surface of said lower panel.

* * * * *